US005928990A

United States Patent [19]

Guistina et al.

[11] Patent Number: 5,928,990

[45] Date of Patent: Jul. 27, 1999

[54] ASSEMBLAGE FOR THERMAL DYE TRANSFER

[75] Inventors: Robert A. Guistina; Elizabeth G. Burns; Teh-Ming Kung; Kristine B. Lawrence; Richard C. VanHanehem, all of Rochester, N.Y.

[73] Assignee: Eastman Kodak Company, Rochester, N.Y.

[21] Appl. No.: 08/995,825

[22] Filed: Dec. 22, 1997

[51] Int. Cl.[6] ..... B41M 5/035; B41M 5/38

[52] U.S. Cl. ..... 503/227; 428/195; 428/480; 428/913; 428/914

[58] Field of Search ..... 8/471; 428/195, 428/480, 913, 914; 503/227

[56] References Cited

U.S. PATENT DOCUMENTS

| | | | |
|---|---|---|---|
| 4,668,560 | 5/1987 | Kobayashi et al. | 428/195 |
| 5,534,479 | 7/1996 | Shuttleworth et al. | 503/227 |
| 5,627,128 | 5/1997 | Bowman et al. | 503/227 |

*Primary Examiner*—Bruce H. Hess
*Attorney, Agent, or Firm*—Harold E. Cole

[57] ABSTRACT

A thermal dye transfer assemblage comprising:

(I) a dye-donor element comprising a support having thereon sequentially repeating dye layer patches of a dye dispersed in a polymeric binder, at least one of the dye patches containing a deprotonated cationic dye which is capable of being reprotonated to a cationic dye having a N-H group which is part of a conjugated system; and (II) a dye-receiving element comprising a support having thereon a polymeric dye image-receiving layer comprising a polyester polymer which itself does not significantly reprotonate deprotonated cationic dyes which may be transferred from the dye-donor element, to which has been added a hydrated transition metal or metalloid salt of a strong acid;

the dye-receiving element being in a superposed relationship with the dye-donor element so that the dye layer is in contact with the polymeric dye image-receiving layer.

20 Claims, No Drawings

ASSEMBLAGE FOR THERMAL DYE TRANSFER

CROSS REFERENCE TO RELATED APPLICATIONS

Reference is made to commonly-assigned U.S. patent application Ser. Nos. 08/878,924, filed Jun. 19, 1997, entitled "Assemblage for Thermal Dye Transfer" by Bowman et al (Docket 75422HEC); 08/878,717, filed Jun. 19, 1997, entitled "Thermal Dye Transfer Assemblage With Low Tg Polymeric Receiver Mixture" by Harrison et al (Docket 75423HEC); 08/878,951, filed Jun. 19, 1997, entitled "Thermal Dye Transfer Assemblage With Low Tg Polymeric Receiver Mixture" by Kung et al (Docket 75980HEC); 08/878,564, filed Jun. 19, 1997, entitled "Thermal Dye Transfer Assemblage" by Evans et al (Docket 75277HEC); 08/878,565, filed Jun. 19, 1997, entitled "Thermal Dye Transfer Assemblage With Low Tg Polymeric Receiver Mixture" by Lawrence et al (Docket 75979HEC); 08/878,704, filed Jun. 19, 1997, entitled "Assemblage for Thermal Dye Transfer" by Evans et al (Docket 75278HEC); and 08/879,061, filed Jun. 19, 1997, entitled "Assemblage For Thermal Dye Transfer" by Guistina et al (Docket 75894HEC); the disclosures of which are incorporated herein by reference.

FIELD OF THE INVENTION

This invention relates to a thermal dye transfer assemblage wherein the receiver element contains a polyester polymer, an acidic metal salt and a certain surfactant, and the dye-donor element contains a deprotonated cationic dye.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to image degradation by contact with other surfaces, chemicals, fingerprints, etc. Such image degradation is often the result of continued migration of the transferred dyes after the printing step.

Commonly used dyes are nonionic in character because of the easy thermal transfer achievable with this type of compound. The dye-receiver layer usually comprises an organic polymer with polar groups to accept the dyes transferred to it. A disadvantage of such a system is that, since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

DESCRIPTION OF RELATED ART

U.S. Pat. No. 5,534,479 relates to the transfer of a deprotonated cationic dye to a dye image-receiving layer containing an organic acid moiety as part of a polyester polymer which is capable of reprotonating the deprotonated cationic dye. However, there is a problem with the polymers used in this patent in that they contain strong acids which catalyze the hydrolysis of the polyester backbone which changes the properties of the polymer making it more hygroscopic and tacky. In addition, there is no disclosure in this patent that describes the use of mixtures comprising a metal salt capable of reprotonating the deprotonated cationic dyes and a polyester polymer.

U.S. Pat. No. 5,627,128 relates to the transfer of a deprotonated cationic dye to a polymeric dye image-receiving layer comprising a mixture of an organic polymeric or oligomeric acid which is capable of reprotonating the deprotonated cationic dye and a polymer having a Tg of less than about 19° C. and having no or only slight acidity, such as an acrylic, styrene or vinyl polymer which contains ester groups. There is a problem with this polymer mixture, however, in that such organic polymeric or oligomeric acids cause hydrolysis of such ester groups which causes physical properties of the receiver layer to change over time. In addition, there is no disclosure in this patent that describes the use of hydrated transition metal or metalloid salts of strong acids in the receiver to reprotonate the deprotonated cationic dyes.

U.S. Pat. No. 4,668,560 relates to a receiver element which contains a metal compound derived from metal salts of organic acids. However, there is a problem with this type of receiver element in that it does not reprotonate a deprotonated cationic dye transferred to it.

It is an object of this invention to provide a thermal dye transfer assemblage which contains a receiver polymer which is hydrolytically stable. It is another object of this invention to provide a thermal dye transfer assemblage which will reprotonate a deprotonated cationic dye transferred to it.

SUMMARY OF THE INVENTION

These and other objects are achieved in accordance with this invention which relates to a thermal dye transfer assemblage comprising:

(I) a dye-donor element comprising a support having thereon sequentially repeating dye layer patches of a dye dispersed in a polymeric binder, at least one of the dye patches containing a deprotonated cationic dye which is capable of being reprotonated to a cationic dye having a N-H group which is part of a conjugated system; and (II) a dye-receiving element comprising a support having thereon a polymeric dye image-receiving layer comprising a polyester polymer which itself does not significantly reprotonate deprotonated cationic dyes which may be transferred from the dye-donor element, to which has been added a hydrated transition metal or metalloid salt of a strong acid;

the dye-receiving element being in a superposed relationship with the dye-donor element so that the dye layer is in contact with the polymeric dye image-receiving layer.

DESCRIPTION OF THE PREFERRED EMBODIMENTS

Deprotonated cationic dyes useful in the invention which are capable of being reprotonated to cationic dyes having a N-H group which is part of a conjugated system are described in U.S. Pat. No. 5,523,274, the disclosure of which is hereby incorporated by reference.

In a preferred embodiment of the invention, the deprotonated cationic dye employed in the invention and the corresponding cationic dye having a N-H group which is part of a conjugated system have the following structures:

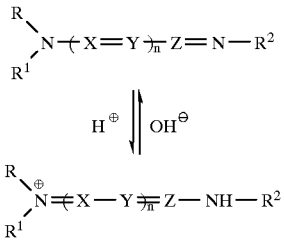

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents a substituted or unsubstituted phenyl or naphthyl group or a substituted or unsubstituted alkyl group from about 1 to about 10 carbon atoms; and n is an integer of from 0 to 11.

The deprotonated cationic dyes according to the above formula are disclosed in U.S. Pat. Nos. 4,880,769, 4,137,042 and 5,559,076, and in K. Venkataraman ed., *The Chemistry of Synthetic Dyes*, Vol. IV, p. 161, Academic Press, 1971, the disclosures of which are hereby incorporated by reference. Specific examples of such dyes include the following (the λmax values and color descriptions in parentheses refer to the dye in its protonated form):

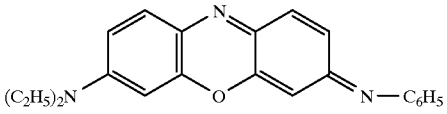

Dye 1
λmax 556 nm (641 nm)
magenta (cyan)
U.S. Pat. No. 4,880,769 (Dye 1)

-continued

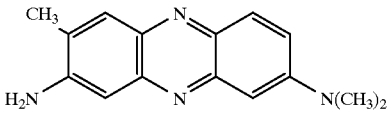

Dye 2
λmax 459 nm (536 nm)
yellow (magenta)

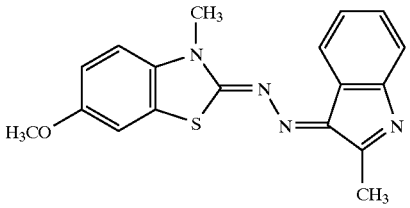

Dye 3
λmax 459 nm (522 nm)
yellow (magenta)

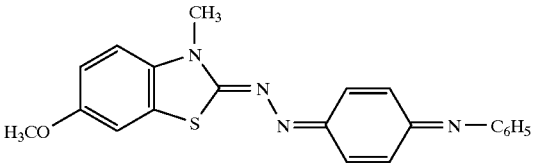

Dye 4
λmax 503 nm (621 nm)
red (blue)

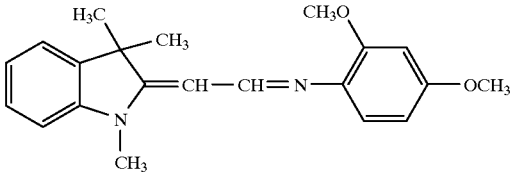

Dye 5
λmax 379 nm (405 nm)
yellow (yellow)

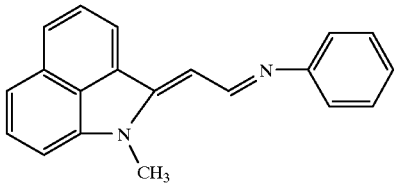

Dye 6
λmax 479 nm (513 nm)
yellow (magenta)

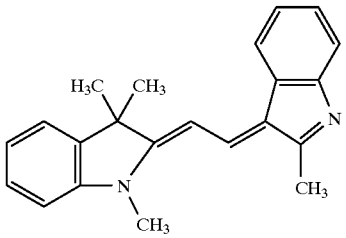

Dye 7
λmax 485 nm (495)
yellow (yellow)

-continued

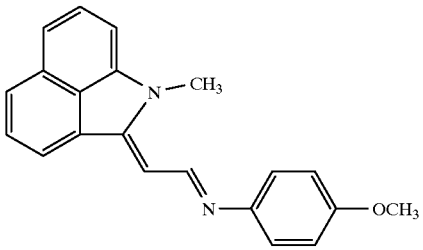

Dye 8
yellow (magenta)
U.S. Pat. No. 5,559,076 (dye precursor 5)

The dyes described above may be employed in any amount effective for the intended purpose. In general, good results have been obtained when the dye is present in an amount of from about 0.05 to about 1.0 g/m$^2$, preferably from about 0.1 to about 0.5 g/m$^2$. Dye mixtures may also be used.

A strong acid for the purposes of the invention comprises an acid having a pKa of less than or equal to about 2.0, where pKa represents the logarithmic value of the reciprocal of the dissociation constant (See, for example, section D-126 in CRC Handbook of Chemistry and Physics, 54th Ed.). Representative strong acids include, e.g., sulfuric, nitric, and hydrochloric acids. The hydrated transition metal or metalloid salt of a strong acid useful in the invention include various hydrated forms of the following transition metal or metalloid salts: aluminum sulfate, aluminum nitrate, aluminum chloride, potassium aluminum sulfate (alum), zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, zirconium (IV) chloride, etc. Mixtures of the above salts and complex salts thereof may also be used. In a preferred embodiment of the invention, the following hydrated transition metal and metalloid salts of a strong acid may be used:

MS-1: $Al_2(SO_4)_3.18H_2O$
MS-2: $AlK(SO_4)_2.12H_2O$
MS-3: $NiSO_4.6H_2O$
MS-4: $ZnSO_4.7H_2O$
MS-5: $CuSO_4.5H_2O$
MS-6: $Fe_2(SO_4)_3.4H_2O$
MS-7: $Al(NO_3)_3.9H_2O$
MS-8: $Ni(NO_3)_2.6H_2O$
MS-9: $Zn(NO_3)_2.6H_2O$
MS-10: $Fe(NO_3)_3.9H_2O$
MS-11: $AlCl_3.6H_2O$

Any amount of hydrated transition metal or metalloid salt of a strong acid can be used in the receiver as long as it is sufficient to fully protonate the dyes transferred to the receiver. In general, good results have been obtained when the hydrated transition metal or metalloid salt of a strong acid is employed at a concentration of from about 0.05 to about 1.5 g/m$^2$, preferably from about 0.1 to about 0.8 g/m$^2$.

Dye image-receiving layers employed in accordance with the invention comprise a polyester polymer which itself does not significantly reprotonate deprotonated cationic dyes. In a preferred embodiment of the invention, the polyester polymer employed in the dye image-receiving layer comprises a polyester of no or only slight acidity (e.g., which exhibits a pKa value of at least about 5.5) synthesized from dicarboxylates and diols according to the following structure:

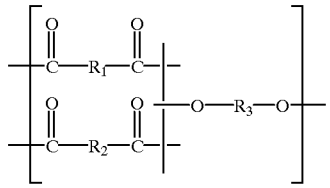

wherein $R_1$ is derived from an aliphatic dicarboxylate, such as adipate, suberate, or sebacate; a cycloaliphatic dicarboxylate, such as cyclopentanedicarboxylate or cyclohexandicarboxylate; an aromatic dicarboxylate, such as isophthalate or terephthalate; or a mixture of any of these;

$R_2$ is derived from a sulfonated dicarboxylate, such as 5-(4-sulfophenoxy)benzene(-1,3)-dicarboxylate, 5-sulphoisophthalate, 5-sulpho-1,3-cyclohexanedicarboxylate or sulfosuccinate;

$R_3$ is derived from an aliphatic diol such as ethylene glycol, propanediol, hexanediol, or decanediol; a fatty acid dimer diol such as Pripol 220® (Unichema Int.); a cycloaliphatic diol, such as cyclohexanedimethanol or tricyclodecanedimethanol; a glycol, such as diethylene glycol, hexaethylene glycol, propylene glycol, tripropylene glycol; prepolymers such as polyethylene glycol or polypropylene glycol; or a mixture of any of these.

In the above formula, $R_1$ may range from about 35 to about 45 mole percent, $R_2$ may range from about 5 to about 15 mole percent, with the balance being $R_3$.

The polyester polymer employed in the dye image-receiving layer may be present in any amount which is effective for its intended purpose. In general, good results have been obtained at a concentration of from about 0.5 to about 10 g/m$^2$. The polymers may be coated from organic solvents or water, if desired.

The polyester polymers employed in the invention may be used alone or in combination with other polymers having no or only slight acidity. These other polymers include condensation polymers such as polyesters, polyurethanes, polycarbonates, etc.; addition polymers such as polystyrenes, vinyl polymers, acrylic polymers, etc.; or copolymers containing segments of more than one type of of polymer covalently linked together. In a preferred embodiment of the invention, an acrylic polymer, a styrene polymer or a vinyl polymer having a Tg of less than 19° C. is used. These other polymers may be employed at a concentration ranging from about 0.5 g/m$^2$ to about 10 g/m$^2$ and may be coated from organic solvents or water, if desired.

Examples of such other polymers include the following:

Polymer A: poly(butyl acrylate-co-allyl methacrylate) 98:2 wt core/poly(glycidyl methacrylate) 10 wt shell, (Tg=−40° C.)

Polymer B: poly(butyl acrylate-co-allyl methacrylate) 98:2 wt core/poly(ethyl methacrylate) 30 wt shell, (Tg=−41° C.)

Polymer C: poly(butyl acrylate-co-allyl methacrylate) 98:2 wt core/poly(2-hydroxypropyl methacrylate) 10 wt shell, (Tg=−40° C.)

Polymer D: poly(butyl acrylate-co-ethylene glycol dimethacrylate) 98:2 wt core/poly(glycidyl methacrylate) 10 wt shell, (Tg=−42° C.)

Polymer E: poly(butyl acrylate-co-allyl methacrylate-co-glycidyl methacrylate) 89:2:9 wt, (Tg=−34° C.)

Polymer F: poly(butyl acrylate-co-ethylene glycol dimethacrylate-co-glycidyl methacrylate) 89:2:9 wt (Tg=−28° C.) Polymer G: poly(butyl methacrylate-co-butyl acrylate-co-allyl methacrylate) 49:49:2 wt core/poly (glycidyl methacrylate) 10 wt shell, (Tg=−18° C.)

Polymer H: poly(methyl methacrylate-co-butyl acrylate-co-2-hydroxyethyl methacrylate-co-2-sulfoethyl methacrylate sodium salt) 30:50:10:10 wt, (Tg=−3° C.)

Polymer I: poly(methyl methacrylate-co-butyl acrylate-co-2-hydroxyethyl methacrylate-co-styrenesulfonic acid sodium salt) 40:40:10:10 wt, (Tg=0° C.)

Polymer J: poly(methyl methacrylate-co-butyl acrylate-co-2-sulfoethyl methacrylate sodium salt-co-ethylene glycol dimethacrylate) 44:44:10:2 wt, (Tg=14° C.)

Polymer K: poly(butyl acrylate-co-Zonyl TM®-co-2-acrylamido-2-methyl-propanesulfonic acid sodium salt) 50:45:5 wt (Tg=−39° C.) (Zonyl TM® is a monomer from the DuPont Company)

Polymer L: XU31066.50 (experimental polymer based on a styrene butadiene copolymer from Dow Chemical Company) (Tg=−31° C.)

Polymer M: AC540® nonionic emulsion (Allied Signal Co.) (Tg=−55° C.)

In accordance with preferred embodiments of the invention, the dye image-receiving layer is coated from an aqueous coating composition comprising the polyester and added hydrated transition metal or metalloid salt of a strong acid. Polymeric surfactants comprising a hydrophobic component containing an aryl radical containing at least 7 carbon atoms and a hydrophilic block component containing at least six repeat units derived from water-soluble monomers, and multifunctional block copolymeric surfactants derived from the sequential addition of propylene oxide or higher alkylene oxide units and subsequently ethylene oxide units to a polyamine moiety, have been found to be particularly effective for stabilizing aqueous dispersions of polyester polymers with added hydrated transition metal or metalloid salts of a strong acids as described in copending, commonly assigned, concurrently filed U.S. Ser. No. 08/995,806, the disclosure of which is incorporated by reference herein.

The general classes of polymeric surfactants for use in accordance with preferred embodiments of the invention are water-soluble or water-dispersible polymers. Preferably, such surfactants have an HLB number of at least 8, more preferably at least about 11, and most preferably at least about 14. The HLB number of a surfactant is a measure of the hydrophilic/lipophilic balance of the compound and can be determined as described in "Polymeric Surfactants," Surfactant Science Series, volume 42, page 221, by I. Piirma.

Preferred polymeric surfactants for use in accordance with one embodiment of the invention comprise a hydrophilic component containing at least six repeat units (preferably from 8 to about 100 repeat units, more preferably at least 10 repeat units, and most preferably at least 14 repeat units) derived from water-soluble monomers, and a hydrophobic component containing a substituted aryl radical containing at least 7 carbon atoms (preferably 12 to 30 carbon atoms, and more preferably 14 to 18 carbon atoms). The hydrophilic component preferably comprises a poly (ethylene oxide) unit, but can be any other water-soluble unit, such as polyethyloxazoline, poly(vinyl alcohol), poly (vinyl pyrrolidone), poly(glycidol) or the like. Particularly preferred surfactants comprise aryl polyoxyethylene ether surfactants represented by Formula I:

I

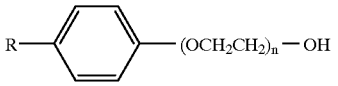

where R is an aryl, alkyl or aralkyl group having from 1 to about 20 carbon atoms, more preferably 6 to 16 carbon atoms, and n has an average value greater than or equal to 10, preferably from about 14 to about 100.

Examples of preferred surfactants according to Formula I and similar compounds include the following:

| Surfactant | Trade Name (Manufacturer) | R | n | HLB |
|---|---|---|---|---|
| D-1 | Triton X-165 ® (Union Carbide Co.) | octylphenol | 16 | 15.8 |
| D-2 | Triton X-305 ® (Union Carbide) | octylphenol | 30 | 17.3 |
| D-3 | Triton X-405 ® (Union Carbide Co.) | octylphenol | 40 | 17.7 |
| D-4 | Triton X-705 ® (Union Carbide Co.) | octylphenol | 70 | 18.7 |
| D-5 | Syn Fac 8216 ® (Milliken Chemical Co.) | bisphenol A based arylphenol | 10–25 | 15 |
| D-6 | Syn Fac 334-13 ® (Milliken Chemical Co.) | bisphenol A based arylphenol | 10–25 | 13 |
| D-7 | Olin 10 G (Olin Chemical Co.) | para-nonylphenol | 8–10* | 15.4 |

*glycidol units rather than ethylene oxide units

Polymeric surfactants for use in accordance with a second preferred embodiment of the invention comprise polyethylene oxide and polypropylene oxide (or higher alkylene oxide) units linked through a polyamine group, such as an ethylene diamine or tetramethylene diamine group. Particularly preferred surfactants in accordance with such embodiment are as indicated in Formula II:

II

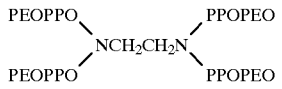

wherein PEO is poly(ethylene oxide) and PPO is poly (propylene oxide). The molecular weight of this material is preferably greater than about 5,000.

Specific examples of the above block copolymeric surfactants of Formula II which may be used in the invention include the following:

| Surfactant | Trade Name | Manufacturer | MW | HLB |
|---|---|---|---|---|
| D-8 | Tetronic ® 1107 | BASF Corp. | 15000 | 24 |
| D-9 | Tetronic ® 1307 | BASF Corp. | 18000 | 24 |
| D-10 | Tetronic ® 904 | BASF Corp. | 6700 | 15 |
| D-11 | Tetronic ® 704 | BASF Corp. | 5500 | 15 |
| D-12 | Tetronic ® 908 | BASF Corp. | 25000 | 31 |

Generally, polymeric surfactants useful in preferred embodiments of the present invention are well known in the art and many of them are commercially available as indicated above. Typically the surfactant comprises water-soluble or dispersible polymers either linear or branched. Preferred surfactants comprise various poly(ethylene oxide) block containing polymers. The preferred surfactants are amphipathic in nature. Such a surfactant comprises in its molecule an oleophilic group of sufficient length to adsorb firmly to the surface of the dispersed polymer particles and also comprises a hydrophilic group of sufficient length to provide a large enough steric barrier to interparticle attraction. The hydrophilic segment may or may not comprise ionic groups and the oleophilic segment may or may not comprise polarizable groups. Ionic groups, if present, in the hydrophilic segment of the polymer provide added colloidal stabilization through ionic repulsion between the dispersed particles of the polymer. The polarizable groups, if present, in the oleophilic segment of the polymer further enhance association of the surfactant with dispersed hydrophobic polymers.

Any amount of aromatic polyether surfactant or block copolymeric surfactant can be used in the receiving element employed in the invention as long as enough is present to stabilize the polyester dispersion in the presence of the hydrated transition metal or metalloid salt of a strong acid. In general, good results have been obtained when these materials are employed at a concentration of from about 0.10 to about 2.15 g/m$^2$ preferably from about 0.5 to about 1.6 g/m$^2$.

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layers to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239; and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal print heads. Such materials include polyesters such as poly (ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

Dye-donor elements used in the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly (vinyl acetal) such as poly(vinyl alcohol-co-butyral). The binder may be used at a coverage of from about 0.1 to about 5 g/m2.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of at least one of the dyes, as described above, capable of generating a cyan, magenta or yellow dye image and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB 2,083,726A.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought into register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

Hydrolytic Stability Testing Control Receiver Element C-1:

This element was prepared by coating a dye image-receiving layer of 5.81 g/m$^2$ of acidified poly[isophthalic acid-co-5-sulfoisophthalic acid (90:10 molar ratio)-diethylene glycol (100 molar ratio)](sulfonic acid form of AQ29D® anionic polyester, Eastman Chemical Company) and 0.54 g/m$^2$ of Olin 10G® (Olin Chemicals), from distilled water on an unsubbed poly(ethylene terephthalate) support (Estar®, Eastman Chemical Co.).

Receiver Element 1

Receiver Element 1 was prepared as described in C-1 except the polyester used was AQ29D® (which is supplied as a sodium salt).

Receiver Elements 2–4 of the Invention

Receiver Elements 2 through 4 were prepared as described in C-1 except the dye image-receiving layer was a mixture of 5.81 g/m$^2$ of AQ29D®, 0.54 g/m$^2$ of Olin 10G®, and metal salts MS-1, MS-7, or MS-9 coated from distilled water. The dry laydowns (g/m$^2$) for the metal salts were chosen to provide levels of acidity (based on molecular weight) equivalent to 0.59 g/m$^2$ of MS-1 ($Al_2(SO_4)_3.18H_2O$). The molecular weight (MW) of each metal salt and dry laydowns for the metal salts and receiver polymer are summarized in Table 1.

TABLE 1

| Receiver Element | Metal Salt (MS) | MW of MS | Laydown of MS (g/m$^2$) |
|---|---|---|---|
| 2 | MS-1 | 666.45 | 0.59 |
| 3 | MS-7 | 375.10 | 0.33 |
| 4 | MS-9 | 297.50 | 0.24 |

The Control Receiver Element C-1 and Receiver elements 1 through 4 were then incubated at 50° C. and 50% RH for one week. In addition, a control sample of each of these coatings was kept in a freezer for one week. Subsequently, both the incubated and freezer polymer coatings were dissolved off the support with tetrahydrofuran.

The dissolved coatings were then analyzed by size exclusion chromatography on a column system comprised of two Waters HT 6E and one HT 2E Styragel® mixed bed columns using N,N-dimethyformamide containing 0.01 M lithium nitrate as elution solvent to give poly(ethylene oxide) equivalent molecular weight. The system was standardized using known molecular weight poly(ethylene oxide) standards and the results are summarized in Table 2 below:

TABLE 2

| Receiver Element | MW of Freezer Coatings[1] | MW of Incubated Coatings[2] | % MW Loss[3] |
|---|---|---|---|
| C-1 | 6230 | 2440 | 61% |
| 1 | 19400 | 19900 | −3% |
| 2 | 19600 | 20000 | −2% |
| 3 | 21000 | 18900 | 10% |
| 4 | 20400 | 19000 | 7% |

[1]coatings stored in a freezer for 1 week
[2]coatings incubated at 50° C. and 50% RH for 1 week
[3][(MW of Freezer)-(MW of Incubated)]/(MW of Freezer) × 100

The above data show that significant losses of molecular weight were observed with the freezer coating containing a strong acid (C-1) relative to the analogous coating that did not contain the strong acid (1). In addition, the molecular weight of the freezer polymer in C-1 further decreased after incubation. Receiver elements that contain a hydrated transition metal salt of a strong acid (2–4) show no or only slight losses of MW after incubation relative to the freezer coatings. This indicates that the polyester backbone in C-1 is very unstable in strongly acidic environments, which results in degradation of physical properties.

Example 2

Preparation of Polymers P-1 to P-12

Synthesis: 0.25 moles of dimethyl esters of the desired dicarboxylate linkages and 0.25 moles of the diols were weighed into a 250 mL round-bottom, long-necked flask. A take-off arm was attached to the top of the flask. Under a nitrogen stream, the monomers were first melted at 250° C., and then the molten monomers were purged with nitrogen. Antimony (III) oxide, 0.5 mL of a 6% dispersion in ethylene glycol, was then added. Five drops of neat titanium isopropoxide were added, and the resulting methanol distillate was collected. After two hours, a vacuum manifold and a stir paddle were attached to the flask, and a vacuum applied with stirring. The reaction continued for two hours under vacuum. The flask was then allowed to cool to room temperature for 30 min., before the vacuum was released. Polymers were isolated by freezing the flasks in liquid nitrogen and then breaking them. The general structure of Polymers P-1 through P-12 is shown below and the molar ratios of the repeat units are shown in Table 3.

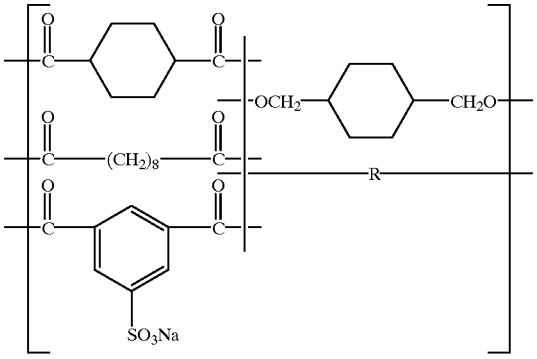

TABLE 3

| | R | mole % R | Mole % SIP[a] | Mole % CHDC[b] | Mole % SEB[c] | Mole % CHDM[d] | Tg (° C.) |
|---|---|---|---|---|---|---|---|
| P-1 | Poly(propylene glycol) MW 4000 | 1 | 8 | 42 | 0 | 49 | 53 |
| P-2 | Poly(ethylene glycol) MW 200 | 1 | 8 | 42 | 0 | 49 | 32 |
| P-3 | Poly(ethylene glycol) MW 2000 | 1 | 8 | 42 | 0 | 49 | 21 |
| P-4 | Poly(propylene glycol) MW 425 | 6 | 8 | 42 | 0 | 44 | 13 |
| P-5 | Poly(ethylene glycol) MW 200 | 16 | 8 | 42 | 0 | 34 | 11 |
| P-6 | Poly(propylene glycol) MW 425 | 8 | 8 | 42 | 0 | 42 | 4 |
| P-7 | Poly(ethylene glycol) MW 2000 | 2 | 8 | 42 | 0 | 48 | 2 |
| P-8 | Poly(ethylene glycol) MW 2000 | 2 | 8 | 42 | 0 | 48 | 0.1 |

TABLE 3-continued

| | R | mole % R | Mole % SIP[a] | Mole % CHDC[b] | Mole % SEB[c] | Mole % CHDM[d] | Tg (° C.) |
|---|---|---|---|---|---|---|---|
| P-9 | Poly(ethylene glycol) MW 2000 | 2 | 8 | 21 | 21 | 48 | −21 |
| P-10 | Poly(ethylene glycol) MW 200 | 16 | 8 | 21 | 21 | 34 | −22 |
| P-11 | Poly(propylene glycol) MW 425 | 6 | 8 | 21 | 21 | 44 | −24 |
| P-12 | Poly(propylene glycol) MW 425 | 8 | 8 | 21 | 21 | 42 | −25 |

[a]SIP = sulfoisophthalate
[b]CHDC = 1,4-cyclohexanedicarboxylate,
[c]SEB = sebacate
[d]CHDM = cyclohexanedimethanol The polymers of Table 3 were used to prepare the dye-receiving elements 5–16 below as identified in Table 4:

TABLE 4

| Receiver Element | Polymer ID |
|---|---|
| 5 | P-1 |
| 6 | P-2 |
| 7 | P-3 |
| 8 | P-4 |
| 9 | P-5 |
| 10 | P-6 |
| 11 | P-7 |
| 12 | P-8 |
| 13 | P-9 |
| 14 | P-10 |
| 15 | P-11 |
| 16 | P-12 |

Dye-Donor Elements

Individual dye-donor elements were prepared by coating the following compositions in the order listed on a 6 μm poly(ethylene terephthalate) support:

1) a subbing layer of Tyzor TBT®, a titanium tetrabutoxide, (DuPont Company) (0.16 g/m$^2$) coated from 1-butanol; and
2) an imaging dye layer coated from a tetrahydrofuran/cylopentanone (95/5) solvent mixture, whereby two different binder polymer mixtures with the selected dye as shown in Table 5 were used:
   DB-1 propionate ester of bisphenol A copolymer with epichlorohydrin (prepared by techniques similar to those described in U.S. Pat. No. 5,244,862);
   DB-2 poly(butyl methacrylate-co-Zonyl TM®) (75/25) where Zonyl TM® is a perfluoro monomer available from DuPont.

Details of dye and binder laydowns are summarized in the following Table 5:

TABLE 5

| Dye-Donor Element | Deprotonated Dye | Dye Laydown, (g/m$^2$) | DB-1 Laydown, (g/m$^2$) | DB-2 Laydown, (g/m$^2$) |
|---|---|---|---|---|
| Yellow | Dye 5 | 0.28 | 0.28 | 0.07 |
| Cyan | Dye 1 | 0.15 | 0.17 | 0.06 |

On the back side of the dye-donor element were coated the following compositions in the order listed:

1) a subbing layer of Tyzor TBT®, a titanium tetrabutoxide, (DuPont Company) (0.16 g/m$^2$) coated from 1-butanol; and
2) a slipping layer of 0.38 g/m$^2$ poly(vinyl acetal) (Sekisui), 0.022 g/m$^2$ Candelilla wax dispersion (7% in methanol), 0.011 g/m$^2$ PS513 amino-terminated polydimethylsiloxane (Huels) and 0.0003 g/m$^2$ p-toluenesulfonic acid coated from a 3-pentanone/distilled water (98/2) solvent mixture.

Control Receiver Element C-2:

The element was prepared by first extrusion laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of Prosil® 221 (0.05 g/m$^2$) and Prosil® 2210 (0.05 g/m$^2$) (PCR, Inc.) coated from 3A alcohol; and
2) a dye-receiving layer composed of a mixture of 2.69 g/m$^2$ of the polyester, poly[isophthalatic acid-co-5-sulfoisophthalic acid (90:10 molar ratio)-diethylene glycol (100 molar ratio)] (sulfonic acid of AQ29D®, Eastman Chemical Company), 4.04 g/m$^2$ of core-shell type polyacrylate latex (C/S-Pa) Polymer A, and 0.022 g/m$^2$ of a fluorocarbon surfactant (Fluorad ® FC-170, 3M Corporation), coated from distilled water. This composition was analogous to Receiver Elements 7 through 18 in Example 1 of U.S. Pat. No. 5,627,128.

Receiver Elements 5 through 16 of the Invention

Receiver Elements 5–16 were prepared as described above for Control Receiver Element C-2, except the subbing layer was 0.02 g/m$^2$ Polymin P® polyethyleneimine (BASF) coated from distilled water and the dye receiving layer was composed of a mixture of 5.1 g/m$^2$ polyester P-1 through P-12, 1.1 g/m$^2$ of Syn Fac 8216® (Milliken Chemicals) and 0.59 g/m$^2$ of MS-1 ($Al_2(SO_4)_3.18H_2O$).

Preparation and Evaluation of Thermal Dye Transfer Images

Eleven-step sensitometric cyan thermal dye transfer images were prepared from the above dye-donor and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head (TDK No. 8I0625 with a resolution of 5.4 dots/mm, thermostatted at 25° C.) was pressed with a force of 24.4 Newton (2.5 kg) against the dye donor element side of the assemblage, pushing it against the rubber roller.

The imaging electronics were activated causing the donor-receiver assemblage to be drawn through the print head/roller nip at 40.3 mm/sec. Coincidentally, the resistive elements in the thermal print head were pulsed for 127.75

μs/pulse at 130.75 μs intervals during a 4.575 msec/dot printing cycle (including a 0.391 msec/dot cool-down interval). A stepped image density was generated by incrementally increasing the number of pulses/dot from a minimum of 0 to a maximum of 32 pulses/dot. The voltage supplied to the thermal head was approximately 12.5 v resulting in an instantaneous peak power of 0.294 watts/dot and a maximum total energy of 1.20 mJ/dot. This procedure was done using the cyan dye-donor element to produce a cyan stepped image. Print room humidity: 45% RH.

For images containing a cyan dye, protonation causes a color change from the deprotonated dye form (magenta) to the protonated dye form (cyan). This color change can be monitored by measuring status A red (cyan) and green (magenta) densities and calculating a red/green ratio as a function of time.

After printing, the dye-donor element was separated from the imaged receiving element. The prints were then placed into a 50° C./50% RH oven for 3.0 hours. Prints were removed from the oven and the Status A reflection red and green densities at step 10 in the stepped-image were measured for the cyan image using an X-Rite 820® Reflection Densitometer (X-Rite Corp.). A red/green (R/G) ratio (minus the baseline) was calculated for the cyan image for each receiver. Complete dye reprotonation of the cyan dye in the cyan image occurs when the red/green ratio after incubation is greater than 2.0. The results are summarized in the following Table 6:

TABLE 6

| Receiver Element | Red Density, 3 hrs.[1] | Green Density, 3 hrs.[2] | R/G Ratio 3 hrs., inc.[3] |
|---|---|---|---|
| C-2 | 1.74 | 0.32 | 5.44 |
| 5 | 2.09 | 0.37 | 5.65 |
| 6 | 2.14 | 0.36 | 5.94 |
| 7 | 2.11 | 0.36 | 5.86 |
| 8 | 2.21 | 0.40 | 5.53 |
| 9 | 2.22 | 0.40 | 5.55 |
| 10 | 2.29 | 0.41 | 5.59 |
| 11 | 2.36 | 0.45 | 5.24 |
| 12 | 2.16 | 0.39 | 5.54 |
| 13 | 2.26 | 0.43 | 5.26 |
| 14 | 1.64 | 0.40 | 4.10 |
| 15 | 2.34 | 0.46 | 5.09 |
| 16 | 1.66 | 0.43 | 3.86 |

[1]red density for cyan image after 3 hrs. at 50° C./50% RH
[2]green density for cyan image after 3 hrs. at 50° C./50% RH
[3]red/green ratio for cyan image after 3 hrs. at 50° C./50% RH The above results show that mixing a hydrated transition metal salt of a strong acid and a polyester polymer (Receiver Elements 5 through 16) in accordance with the invention results in the protonation of the transferred deprotonated dye in amounts comparable to that achieved with the control receiver element of C-2. Although a high R/G ratio was achieved with control C-2, the polymer in the receiver was found to be hydrolytically unstable (see Example 1).

Example 3

Preparation of Polyester Polymers P-14 to P-23

These materials were prepared the same as in Example 2 using the monomers indicated in Table 7, except that: the monomers were melted and purged at 200° C. This temperature was maintained for two hours. When the vacuum manifold and stir paddle were attached, the temperature was increased to 250° C. The polyester polymers had the general structure as shown below, and the molar ratios of the repeat units are shown in Table 7.

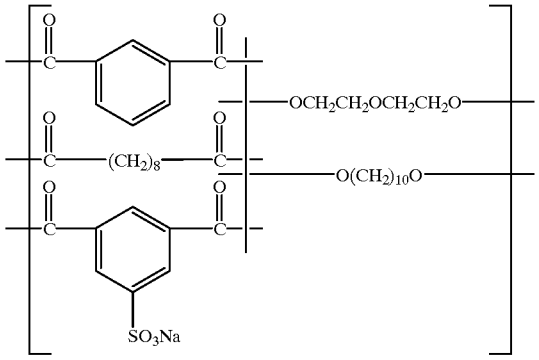

TABLE 7

| | mole % isophthalate | Mole % 5-sulpho-isopthalate | mole % sebacate | mole % diethylene glycol | mole % decane diol | Tg ° C. |
|---|---|---|---|---|---|---|
| P-14 | 45 | 5 | 0 | 50 | 0 | 27 |
| P-15 | 45 | 5 | 0 | 45 | 5 | 19 |
| P-16 | 45 | 5 | 0 | 40 | 10 | 8 |
| P-17 | 45 | 5 | 0 | 35 | 15 | 10 |
| P-18 | 45 | 5 | 0 | 30 | 20 | 2 |
| P-19 | 45 | 5 | 0 | 25 | 25 | −3 |
| P-20 | 40 | 5 | 5 | 50 | 0 | 14 |
| P-21 | 35 | 5 | 10 | 50 | 0 | 3 |
| P-22 | 30 | 5 | 15 | 50 | 0 | −14 |
| P-23 | 25 | 5 | 10 | 50 | 0 | −20 |

The polymers of Table 7 were used to prepare the dye-receiving elements as in receiver elements 17–27 below as identified in Table 8:

TABLE 8

| Receiver Element | Polymer ID |
|---|---|
| 17 | P-13* |
| 18 | P-14 |
| 19 | P-15 |
| 20 | P-16 |
| 21 | P-17 |
| 22 | P-18 |
| 23 | P-19 |
| 24 | P-20 |
| 25 | P-21 |
| 26 | P-22 |
| 27 | P-23 |

*Polymer P-13 is AQ29D ® (Eastman Chemical Co.) which is described above.

Dye-Donor Elements

Individual dye-donor elements were prepared as described in Example 2 except the dye and binder laydowns used were different and are summarized in the following Table 9:

TABLE 9

| Dye-Donor Element | Deprotonated Dye | Dye Laydown, ($g/m^2$) | DB-1 Laydown, ($g/m^2$) | DB-2 Laydown, ($g/m^2$) |
|---|---|---|---|---|
| Yellow | Dye 5 | 0.28 | 0.29 | 0.05 |
| Cyan | Dye 1 | 0.15 | 0.19 | 0.03 |

Receiver Elements 17 through 27 of the Invention:

Receiver Elements 17–27 were prepared as described above for receiver elements 5–16 in Example 2 above. These elements were evaluated as described in Example 2 and the results are summarized in Table 10 below.

TABLE 10

| Receiver Element | Red Density, 3 hrs.[1] | Green Density, 3 hrs.[2] | R/G Ratio 3 hrs., inc.[3] |
|---|---|---|---|
| C-2 | 1.87 | 0.36 | 5.19 |
| 17 | 1.90 | 0.36 | 5.28 |
| 18 | 1.94 | 0.35 | 5.54 |
| 19 | 2.47 | 0.41 | 6.02 |
| 20 | 2.50 | 0.44 | 5.68 |
| 21 | 2.69 | 0.48 | 5.60 |
| 22 | 2.58 | 0.47 | 5.49 |
| 23 | 2.58 | 0.51 | 5.06 |
| 24 | 2.44 | 0.42 | 5.81 |
| 25 | 2.31 | 0.49 | 4.71 |
| 26 | 2.02 | 0.46 | 4.39 |

[1]red density for cyan image after 3 hrs. at 50° C./50% RH
[2]green density for cyan image after 3 hrs. at 50° C./50% RH
[3]red/green ratio for cyan image after 3 hrs. at 50° C./50% RH The above results show that mixing a hydrated transition metal salt of a strong acid and a polyester polymer (Receiver Elements 17 through 26) in accordance with the invention results in the protonation of the transferred deprotonated dye in amounts comparable to that achieved with the control receiver element of C-2. Although a high R/G ratio was achieved with control C-2, the polymer in the receiver was found to be hydrolytically unstable (see Example 1).

Example 4

Blends of Polymer A, polyester, aromatic polyether surfactant and metal salt

Control Receiver Element C-3

This element was prepared by first extrusion-laminating a paper core with a 38 $\mu$m thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of Polymin P® polyethylenimine (0.02 g/m$^2$)(BASF Corp.) coated from deionized water; and
2) a dye-receiving layer of a mixture of 2.75 g/m$^2$ of a sulfonic acid of AQ29D® polyester (or acidified P-13), 4.13 g/m$^2$ Polymer A, and 0.02 g/m$^2$ Fluorad FC-170C® perfluorinated surfactant (3M Corp.), coated from distilled water.

Control Receiver Element C-4

This element was prepared the same as Control C-3 except that the polyester was AQ29D® (P-13).

Receiver Elements 28 and 29 of the Invention

Receiver element 28 was prepared as described above for control receiver element C-3 and C-4, except the dye-receiving layer was a mixture of 0.61 g/m$^2$ of hydrated aluminum sulfate [$Al_2(SO_4)_3.18H_2O$](MS-1), 2.15 g/m$^2$ AQ29D® polyester (P-13), 3.3 g/m$^2$ Polymer A, and 0.83 g/m$^2$ nonionic polymeric surfactant of an aryl polyoxyethylene ether, Syn Fac® 8216, (Milliken Chemicals), coated from distilled water.

Receiver element 29 was prepared as described above for control receiver element C-3 and C-4, except the dye-receiving layer was a mixture of 0.28 g/m$^2$ of hydrated zinc nitrate [$Zn(NO_3)_2.6H_2O$](MS-9), 2.15 g/m$^2$ AQ29D® polyester (P-13), and 3.91 g/m$^2$ Polymer A, and 0.55 g/m$^2$ of Syn Fac® 8216 coated from distilled water.

The dry laydown of the control receiver elements C-3 and C-4, and receiver elements 28 and 29 are also summarized in Table 11 below.

TABLE 11

| Receiver Element | Metal Salt Laydown (g/m$^2$) | Acidified P-13 Laydown (g/m$^2$) | P-13 Laydown (g/m$^2$) | Polymer A Laydown (g/m$^2$) | Surfactant Laydown (g/m$^2$) |
|---|---|---|---|---|---|
| Control 3 | 0 | 2.75 | 0 | 4.13 | FC 170C ® (0.02) |
| Control 4 | 0 | 0 | 2.75 | 4.13 | FC 170C ® (0.02) |
| 28 | MS-1 (0.61) | 0 | 2.15 | 3.3 | Syn Fac 8216 ® (0.83) |
| 29 | MS-9 (0.28) | 0 | 2.15 | 3.91 | Syn Fac 8216 ® (0.55) |

Thermal dye transfer prints were prepared and evaluated as described in Example 2, except the voltage supplied to the thermal head was approximately 12 volts resulting in an instantaneous peak power of 0.289 watts/dot and a maximum total energy of 1.18 mJ/dot. In addition, the print room humidity was 44% RH and the red/green (R/G) ratio at step 11 for the cyan dye in the stepped cyan image was determined for 1, 5, and 20 minutes instead. The results are summarized in the following Table 12:

TABLE 12

| Receiver Element | R/G ratio 1 min. | R/G ratio 5 min. | R/G ratio 20 min. |
|---|---|---|---|
| Control 3 | 2.65 | 3.88 | 5.1 |
| Control 4 | 0.29 | 0.29 | 0.29 |
| 28 | 3.15 | 4.71 | 5.18 |
| 29 | 3.56 | 3.96 | 4.82 |

The above results show that mixing a hydrated metal salt of a strong acid and a polyester polymer (AQ29D® or P-13), along with an acrylic polymer (Polymer A), and a nonionic surfactant of the aryl polyoxyethylene ether type (receiver elements 28 and 29) can achieve a dye conversion performance (R/G ratio) very comparable to that of the control receiver element of C-3, without having the disadvantage of C-3 being hydrolytically unstable (Example 1). The results also show that no dye conversion (or dye protonation) takes place in control receiver element C-4 which contains no metal salt of a strong acid as indicated by a R/G ratio of <2.0.

Example 5

Blends of Polymer A, polyester, block copolymer of ethylene oxide and propylene oxide surfactant, and metal salt Control Receiver Element C-3 and C-4 were used as described in Example 4 above.

Receiver Elements 30–33 of the Invention

Receiver element 30 was prepared as described above for Control Receiver Element C-3 and C-4, except the dye-receiving layer was a mixture of 0.61 g/m$^2$ of hydrated aluminum sulfate [$Al_2(SO_4)_3.18H_2O$](MS-1), 2.15 g/m$^2$ AQ29D® polyester (P-13), and 2.75 g/m$^2$ Polymer A, and 1.38 g/m$^2$ of a nonionic polymeric surfactant of a block copolymer of ethylene oxide and propylene oxide, Tetronic 1107®, coated from distilled water.

Receiver element 31 was prepared as described above for Receiver element 30, except that the surfactant was Tetronic 908®.

Receiver element 32 was prepared as described above for control receiver element C-3 and C-4, except the dye-receiving layer was a mixture of 0.28 g/m$^2$ of hydrated zinc nitrate [$Zn(NO_3)_2.6H_2O$](MS-9), 2.15 g/m$^2$ AQ29D® polyester (P-13), and 3.08 g/m$^2$ Polymer A, and 1.38 g/m$^2$ of Tetronic 1107® coated from distilled water.

Receiver element 33 was prepared as described above for Receiver element 32, except that the surfactant was Tetronic 908®.

The dry laydowns of control receiver elements C-3 and C-4, and receiver elements 30–33 are also summarized in Table 13 below.

TABLE 13

| Receiver Element | Metal Salt Laydown (g/m$^2$) | Acidified P-13 Laydown (g/m$^2$) | P-13 Laydown (g/m$^2$) | Polymer A Laydown (g/m$^2$) | Surfactant Laydown (g/m$^2$) |
|---|---|---|---|---|---|
| Control 3 | 0 | 2.75 | 0 | 4.13 | FC 170C ® (0.02) |
| Control 4 | 0 | 0 | 2.75 | 4.13 | FC 170C ® (0.02) |
| 30 | MS-1 (0.61) | 0 | 2.15 | 2.75 | Tetronic 1107 ® (1.38) |
| 31 | MS-1 (0.61) | 0 | 2.15 | 2.75 | Tetronic 908 ® (1.38) |
| 32 | MS-9 (0.28) | 0 | 2.15 | 3.08 | Tetronic 1107 ® (1.38) |
| 33 | MS-9 (0.28) | 0 | 2.15 | 3.08 | Tetronic 908 ® (1.38) |

Thermal dye transfer prints were prepared and evaluated as described in Example 2, except the voltage supplied to the thermal head was approximately 13 volts resulting in an instantaneous peak power of 0.339 watts/dot and a maximum total energy of 1.39 mJ/dot. In addition, the print room humidity was 44% RH and the red/green (R/G) ratio at step 11 for the cyan dye in the stepped cyan image was determined for 1, 5, and 20 minutes instead. The results are summarized in the following Table 14:

TABLE 14

| Receiver Element | R/G ratio 1 min. | R/G ratio 5 min. | R/G ratio 20 min. |
|---|---|---|---|
| Control 3 | 4.19 | 5.08 | 5.39 |
| Control 4 | 0.29 | 0.29 | 0.29 |
| 30 | 4.33 | 5.41 | 5.45 |
| 31 | 3.97 | 4.26 | 4.32 |
| 32 | 4.36 | 4.66 | 5.2 |
| 33 | 4.65 | 5.18 | 5.45 |

The above results show that mixing a hydrated metal salt of a strong acid and a polyester polymer (AQ29D® or P-13), along with an acrylic polymer (Polymer A) and a nonionic surfactant of a block copolymer of ethylene oxide and propylene oxide (receiver elements 30–33) can achieve a dye conversion performance (R/G ratio) very comparable to that of the control receiver element of C-3, without the disadvantage of C-3 being hydrolytically unstable (Example 1). The results also show that no dye conversion (or dye protonation) takes place in control receiver element C-4 which contains no metal salt of a strong acid as indicated by a R/G ratio of <2.0.

The invention has been described in detail with particular reference to preferred embodiments thereof, but it will be understood that variations and modifications can be effected within the spirit and scope of the invention.

What is claimed is:

1. A thermal dye transfer assemblage comprising:

(I) a dye-donor element comprising a support having thereon sequentially repeating dye layer patches of a dye dispersed in a polymeric binder, at least one of said dye patches containing a deprotonated cationic dye which is capable of being reprotonated to a cationic dye having a N-H group which is part of a conjugated system; and (II) a dye-receiving element comprising a support having thereon a polymeric dye image-receiving layer comprising a polyester polymer which itself does not significantly reprotonate deprotonated cationic dyes which may be transferred from the dye-donor element, to which has been added a hydrated transition metal or metalloid salt of a strong acid;

said dye-receiving element being in a superposed relationship with said dye-donor element so that said dye layer is in contact with said polymeric dye image-receiving layer.

2. The assemblage of claim 1 wherein said polyester polymer comprises a polyester synthesized from a dicarboxylate and a diol according to the following structure:

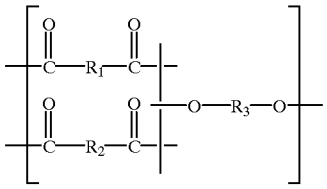

wherein $R_1$ is derived from an aliphatic dicarboxylate, a cycloaliphatic dicarboxylate, or an aromatic dicarboxylate;

$R_2$ is derived from a sulfonated dicarboxylate; and $R_3$ is derived from an aliphatic diol, a fatty acid dimer diol, a cycloaliphatic diol, a glycol, or a prepolymer.

3. The assemblage of claim 1 wherein said hydrated transition metal or metalloid salt of a strong acid is a hydrated form of: aluminum sulfate, aluminum nitrate, aluminum chloride, potassium aluminum sulfate, zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, or zirconium (IV) chloride.

4. The assemblage of claim 1 wherein said receiving layer contains $Al_2(SO_4)_3.18H_2O$, $AlK(SO_4)_2.12H_2O$, $NiSO_4.6H_2O$, $ZnSO_4.7H_2O$, $CuSO_4.5H_2O$, $Fe_2(SO_4)_3.4H_2O$, $Al(NO_3)_3.9H_2O$, $Ni(NO_3)_2.6H_2O$, $Zn(NO_3)_2.6H_2O$, $Fe(NO_3)_3.9H_2O$ or $AlCl_3.6H_2O$.

5. The assemblage of claim 1 wherein said hydrated transition metal or metalloid salt of a strong acid is employed at a concentration of from about 0.05 to about 1.5 g/m$^2$.

6. The assemblage of claim 1 wherein the dye image-receiving layer further comprises a polymeric surfactant comprising a hydrophobic component containing an aryl radical containing at least 7 carbon atoms and a hydrophilic block component containing at least six repeat units derived from water-soluble monomers, or a multifunctional block copolymeric surfactant derived from the sequential addition of propylene oxide or higher alkylene oxide units and subsequently ethylene oxide units to a polyamine moiety.

7. The assemblage of claim 1 wherein said dye image-receiving layer further comprises a surfactant derived from the sequential addition of propylene oxide and ethylene oxide to a diamino moiety and has the following formula:

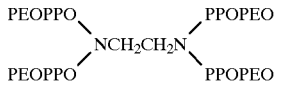

wherein PEO is poly(ethylene oxide) and PPO is poly (propylene oxide).

8. The assemblage of claim 1 wherein said dye image-receiving layer further comprises a nonionic, polymeric surfactant of an aryl polyoxyethylene ether having the formula:

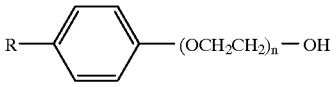

where R is an aryl, alkyl or aralkyl group having from 1 to about 20 carbon atoms, and n has an average value greater than or equal to 10.

9. The assemblage of claim 1 wherein said receiving layer also contains an additional polymer having no or only slight acidity.

10. The assemblage of claim 9 wherein said additional polymer is an acrylic polymer, a vinyl polymer or a styrene polymer.

11. A process of forming a dye transfer image comprising imagewise-heating a dye-donor element comprising a support having thereon a dye layer comprising a dye dispersed in a polymeric binder, and imagewise transferring said dye to a dye-receiving element to form said dye transfer image, wherein said dye-donor element comprises a support having thereon sequentially repeating dye layer patches of a dye dispersed in a polymeric binder, at least one of said dye patches containing a deprotonated cationic dye which is capable of being reprotonated to a cationic dye having a N-H group which is part of a conjugated system; and said dye-receiving element comprises a support having thereon a polymeric dye image-receiving layer comprising a polyester polymer which itself does not significantly reprotonate deprotonated cationic dyes which may be transferred from the dye-donor element, to which has been added a hydrated transition metal or metalloid salt of a strong acid.

12. The process of claim 11 wherein said polyester polymer comprises a polyester synthesized from a dicarboxylate and a diol according to the following structure:

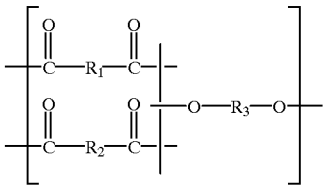

wherein $R_1$ is derived from an aliphatic dicarboxylate, a cycloaliphatic dicarboxylate, or an aromatic dicarboxylate;

$R_2$ is derived from a sulfonated dicarboxylate; and $R_3$ is derived from an aliphatic diol, a fatty acid dimer diol, a cycloaliphatic diol, a glycol, or a prepolymer.

13. The process of claim 11 wherein said hydrated transition metal or metalloid salt of a strong acid is a hydrated form of: aluminum sulfate, aluminum nitrate, aluminum chloride, potassium aluminum sulfate, zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, or zirconium (IV) chloride.

14. The process of claim 11 wherein said receiving layer contains $Al_2(SO_4)_3.18H_2O$, $AlK(SO_4)_2.12H_2O$, $NiSO_4.6H_2O$, $ZnSO_4.7H_2O$, $CuSO_4.5H_2O$, $Fe_2(SO_4)_3.4H_2O$, $Al(NO_3)_3.9H_2O$, $Ni(NO_3)_2.6H_2O$, $Zn(NO_3)_2.6H_2O$, $Fe(NO_3)_3.9H_2O$ or $AlCl_3.6H_2O$.

15. The process of claim 11 wherein said hydrated transition metal or metalloid salt of a strong acid is employed at a concentration of from about 0.05 to about 1.5 $g/m^2$.

16. The process of claim 11 wherein the dye image-receiving layer further comprises a polymeric surfactant comprising a hydrophobic component containing an aryl radical containing at least 7 carbon atoms and a hydrophilic block component containing at least six repeat units derived from water-soluble monomers, or a multifunctional block copolymeric surfactant derived from the sequential addition of propylene oxide or higher alkylene oxide units and subsequently ethylene oxide units to a polyamine moiety.

17. The process of claim 11 wherein said dye image-receiving layer further comprises a surfactant derived from the sequential addition of propylene oxide and ethylene oxide to a diamino moiety and has the following formula:

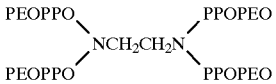

wherein PEO is poly(ethylene oxide) and PPO is poly (propylene oxide).

18. The process of claim 11 wherein said dye image-receiving layer further comprises a nonionic, polymeric surfactant of an aryl polyoxyethylene ether having the formula:

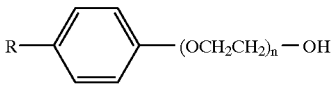

where R is an aryl, alkyl or aralkyl group having from 1 to about 20 carbon atoms, and n has an average value greater than or equal to 10.

19. The process of claim 11 wherein said receiving layer also contains an additional polymer having no or only slight acidity.

20. The process of claim 19 wherein said additional polymer is an acrylic polymer, a vinyl polymer or a styrene polymer.

* * * * *